United States Patent [19]

Casey

[11] 4,003,227

[45] Jan. 18, 1977

[54] PORTABLE AND DETACHABLE DOUBLE CASEMENT WINDOW OPPOSING TURN LATCH HANDLES LOCK SECURING DEVICE

[76] Inventor: Joseph Taggart Casey, 308 El Portal, Hillsborough, Calif. 94010

[22] Filed: Feb. 2, 1976

[21] Appl. No.: 654,473

[52] U.S. Cl. ..... 70/14; 70/19; 70/89; 292/258

[51] Int. Cl.[2] ..... E05B 73/00

[58] Field of Search ..... 70/14, 19, 57, 58, 89, 70/199, DIG. 11, DIG. 19, DIG. 58, DIG. 65; 292/258, 288, 289, 292, 29 C

[56] References Cited

UNITED STATES PATENTS

| | | | |
|---|---|---|---|
| 1,850,602 | 3/1932 | Pineo | 70/262 |
| 2,151,587 | 3/1939 | Cassileth | 292/288 |
| 2,597,583 | 5/1952 | Holmsten | 70/89 |
| 2,899,229 | 8/1959 | Jenks | 292/288 |
| 3,504,405 | 4/1970 | Elliott-Smith | 70/14 X |

*Primary Examiner*—Robert L. Wolfe
*Attorney, Agent, or Firm*—Laforest S. Saulsbury

[57] ABSTRACT

A tumbler lock securing device that can be applied to the double casement windows and doors without altering of the casement structure but can be simply detachably placed over opposing window or door handles in their depending latched positions and locking ratchet arms squeezed through a tumbler lock and pawl mechanism. Pawl levers are upwardly spring pressed toward ratchet teeth on the bottom edges of the locking arms that respectively extend in opposite directions and are released only with a key that turns the tumbler lock centerpiece and a depressible cam fixed thereto that acts upon one of two pawl levers but through an interlock arrangement between one of the pawls and the other so that upward spring action for the both pawls is served by but one compression spring. The lock and pawl mechanism can be separated from the locking arms or can be left locked to one of the casement handles when unlatched. A cross bar portion on the lock and pawl mechanism when the securing device is attached to the window handles to hold them in their latch positions, will underlie the locking stub ends of the latched handles on the wedge wear plate keepers, whereby to further prevent the turning and release of the window handles by one unless provided with a key.

7 Claims, 8 Drawing Figures

FIG. 1
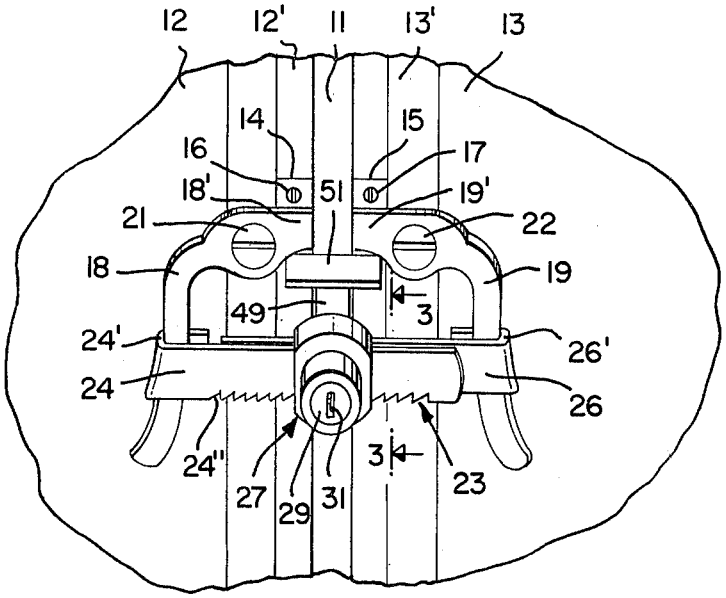
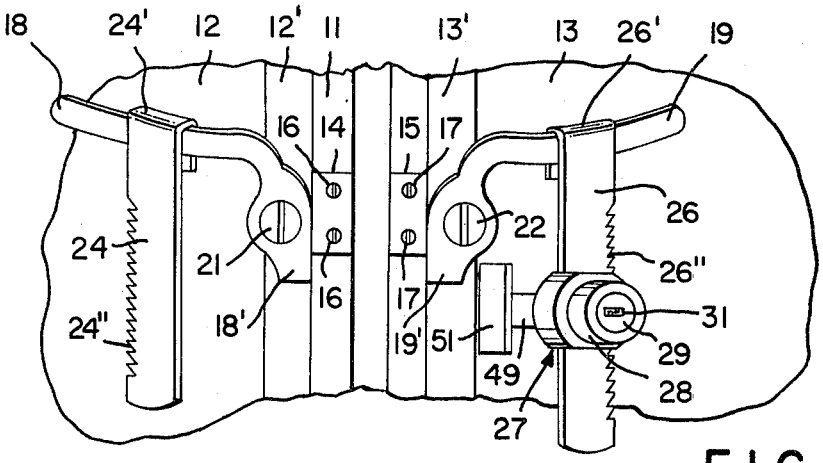
FIG. 2
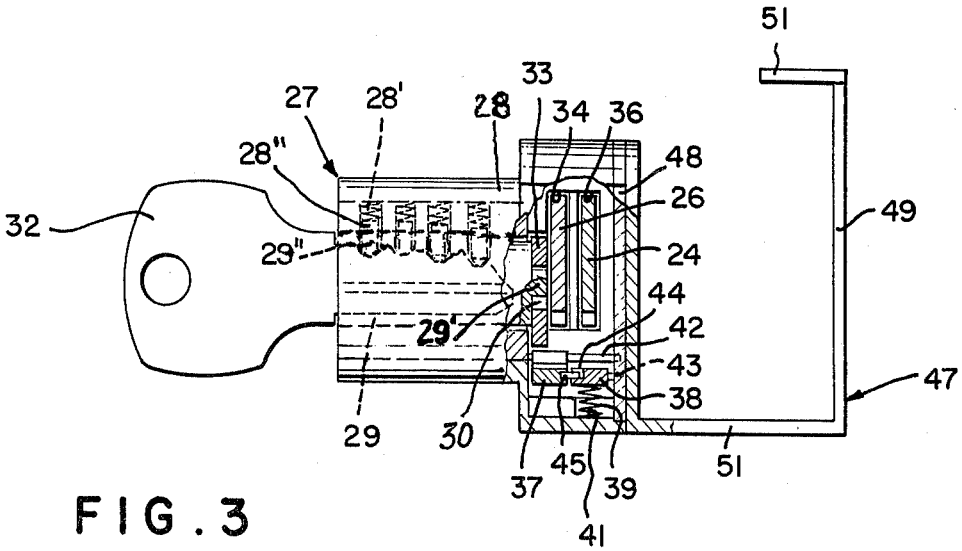
FIG. 3

FIG. 4
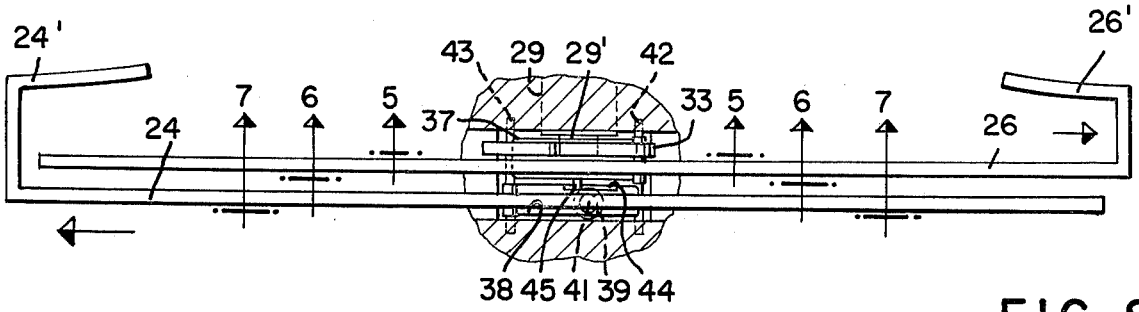
FIG. 8
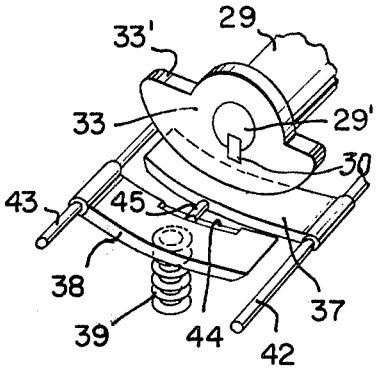
FIG. 5
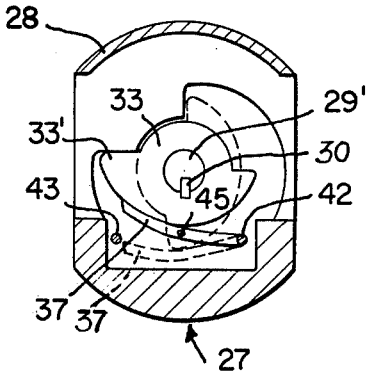
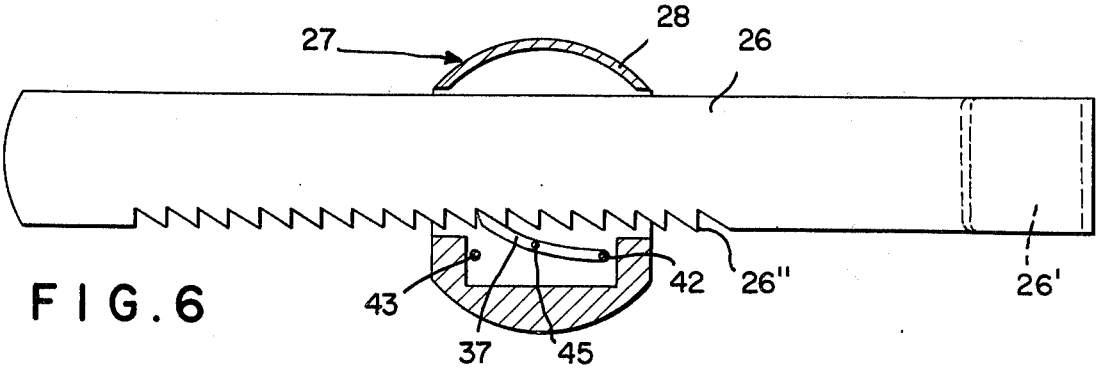
FIG. 6
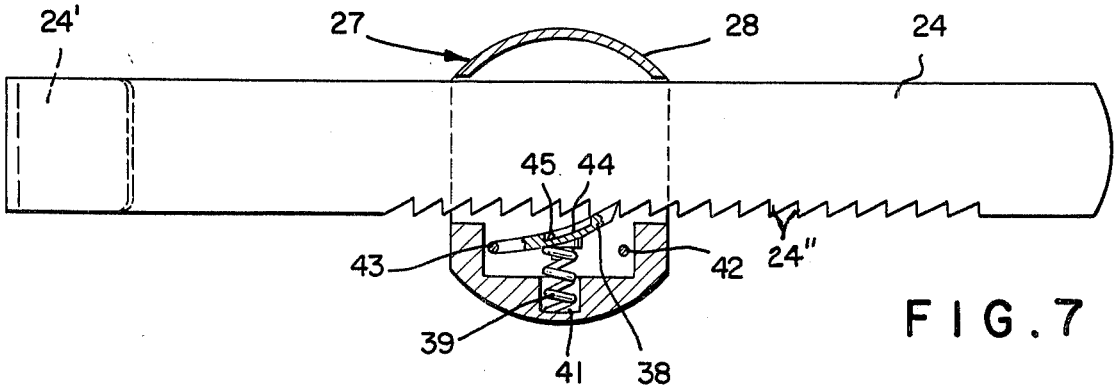
FIG. 7

PORTABLE AND DETACHABLE DOUBLE CASEMENT WINDOW OPPOSING TURN LATCH HANDLES LOCK SECURING DEVICE

The invention relates to a portable and easily detachable window turn handles tumbler key lock securing device for casement windows and doors.

It is the principal object of the present invention to provide a key lock securing device for double casement windows and doors that does not require drilling and insertion of screws to be installed but one which is portable and detachably hung over the depending opposing latch handles and can be taken from one casement structure to another and adjustable to be applied to and carried by any of the shapes of the turned down opposing latch handles to span the space therebetween and yet have parts when released from the tumbler lock can be detachably stored upon or suspended from the upwardly swung latch handles.

It is another object of the invention to provide a portable key lock securing device for locking casement windows which includes a tumbler key lock body and extensible locking arms that can slidably clipped over the depending latched handles wherein the key lock body has a back plate member with cross bar portion that is brought up into engagement with the bottom edges of the latched stub ends of the window handles by sliding the device upwardly on the handles before locking the device to the handles whereby the opposing handles will be further and more solidly locked in a closed wedge-like and fitted manner upon the handles to prevent them further from being unlatched.

It is still another object of the invention is to provide a portable key lock securing device for casement windows which will not mar or scratch the existing hardware of the casement window and that will blend into the decor thereof.

It is still another object of the invention to provide a key lock securing device for easement windows or doors which will keep them tightly shut against the center outside jamb, keep out cold air and dust and that will retain the closure against opening from within or from without, as by breaking a small piece of glass and turning the handles.

Further objects of the invention are to provide a portable, double casement window or door opposing turn handles tumbler key lock securing device, having the above objects in mind, which is of simple construction, easy to affix to the depending lock handles, of pleasing appearance, has a minimum number of parts, inexpensive to manufacture, rugged durable, light in weight, efficient and effective in use.

For a better understanding of the invention, reference may be had to the following detailed description taken in connection with the accompanying drawing, in which:

FIG. 1 is a front top perspective view of the present double casement window or door tumbler key lock securing device assembled upon two opposing casement latch handles to prevent their separation from one another and the opening of the windows.

FIG. 2 is a top perspective view of separated ratchet teeth locking arms of the key lock securing device and the casement window handles or levers turned to their unlatched positions to allow the windows to be opened and the released lock parts respectively suspended from the respective handles.

FIG. 3 is an enlarged side elevational view of the tumbler key lock securing device removed from the window hand latch levers with the ratchet teeth arms being taken in section generally on line 3—3 of FIG. 1 and with the rear back plate its cross arm portion extending rearwardly and upwardly therefrom for engagement with the stub latching ends of the latch handles.

FIG. 4 is a fragmentary top view of the securing device with a portion being broken away to show fully in plan of the top edges of the ratchet teethed locking arms, the pawl levers therefor and of the key lock operating cam.

FIG. 5 is a transverse sectional view of the tumbler key lock securing device as viewed on line 5—5 of FIG. 4 and locking in elevation upon the tumbler key-actuated lock cam shown in full latching and dotted unlatching positions and one of the associated ratchet teeth levers pawl for the inner ratchet teeth arm.

FIG. 6 is a transverse sectional view of the key lock securing device taken generally on the line 6—6 of FIG. 4 but showing only the right ratchet teethed arm in full elevation and its pawl lever pivoted into its engaged and holding position.

FIG. 7 is a transverse sectional view of the key lock securing device taken on line 7—7 of FIG. 4 rearwardly of line 6—6 to show rear pawl lever that receives a pin from the forward pawl lever extended into a top side edge alot in the rear pawl lever and a biasing spring that normally holds up both levers for engagement with the ratchet teeth of both ratchet latch arms, the rear ratchet latching arm being engaged by the rear pawl lever along with the forward ratchet latching arm 26, not shown, but as shown in FIG. 4.

FIG. 8 is a fragmentary perspective view of the pawl levers assembly with their pivot pins showing the side pin interlocking of the pawl levers and with an illustration of the manner in which the cam and the spring are applied to the assembly.

Generally, there has been provided a double casement window or door tumbler key lock securing device that can be attached between the opposing locked handles of the opposite casement windows or doors which is adjustable to the spacings between the different style opposing handles. This securing device is detachably connected to the handles and is not permanently installed upon the handle. It is portable and can be taken from one casement window to another.

Referring now to the figures, 11 represents a central vertically-extending casement window or door jamb post onto the outside of which opposite casement windows 12 and 13 are closed. The central window jamb post 11 has respectively wear latch plates or wedge-like cam face keepers 14 and 15 secured respectively at opposite sides thereof by respective screws 16 and 17. The casement windows 12 and 13 are respectively hinged to the opposite sides of the window opening and the casement window latch handles 18 and 19 are respectively carried pivotally on the inner sides of the windows by respective pivot screws 21 and 22. The latch handles 18 and 19 respectively have stub latch ends 18' and 19' that in their latching positions overlie the wear plates or keepers 14 and 15 as shown in FIG. 1 and their handles are depend from their pivots substantially parallel to one another between which the present key lock securing device indicated generally at 23 can be extended to prevent the separation of the handles and accordingly the opening of the casement windows 12 and 13. Without the securing device 23 detached and with the handles turned upwardly to their unlatched positions shown in FIG. 2 the casement windows 12 and 13 can be opened from their hinges at their opposite side edges by pushing them outwardly with their handles from their closed positions of FIGS. 1 and 2 and outwardly of the door jamb post 11. The securing device 23 is so attached to the casement window handles that parts thereof can be left suspended upon unlatched upturn handles 18 and 19 as shown in FIG. 2 or they can be completely removed from the handles and used upon the handles of other casement windows, the same being easily detachable and portable manner which will become apparent as the description proceeds.

This casement window key lock securing device 23 generally comprises two opposing ratchet arms 24 and 26 that are folded over at their ends to provide hook-like or clip formations 24′ and 26′ by which they are detachably connected respectively to the window handles 18 and 19. The left locking arm 24 has ratchet teeth 24″ running along the bottom edge while the right locking arm 26 has ratchet teeth 26″ that also run its bottom edge. When the window handles are turned to their latched positions as shown in FIG. 1, the ratcheted locking arms are extended from opposite directions through a tumbler lock and pawl mechanism indicated generally at 27, the teeth 24″ and 26″ of the respective arms 24 and 26 respectively extending oppositely. When the lock and pawl mechanism 27 has been unlocked with one or both of the locking arms 24 and 26. These arms can be pulled out of the mechanism 27 and allowed to be suspended from the window handles 18 and 19 as shown in FIG. 2 and the windows 12 and 13 pushed outwardly to open. The mechanism 27 can be locked upon either one of the separated arms 24 and 26 and suspended therewith as illustrated in FIG. 2. Of course, the locking arm parts can be easily slipped off or detached from the window handles for use on other casement windows. These locking arms being adjustable and ratchet through the mechanism 27 allows the securing device to be attached to differently bent styled window handles and to the lock and pawl mechanism 27 permitting the same to be centered between the handles and their stub ends and into vertical alignment with the fixed casement window jamb 11.

In order to provide further locking of the handles 18 and 19 and render the securing device 23 still more effective, a U-shaped back plate member or strut 47, FIGS. 1, 2 and 3, is rigidly secured by its short leg 48 to the back face of the lock and pawl mechanism 27 in central alignment therewith. A back leg 49 longer than the short leg 48 is integrally spaced rearwardly therefrom by a bight portion 51 and has on its upper end a flat T-head cross bar portion 51 adapted when the lock and pawl mechanism 27 is adjusted on the locking arms 24 and 26 centered between handles 18 and 19 and the entire securing device 25 is lifted upon the handles 18 and 19 so that the cross bar portion 51 spans the fixed jamb 11 and its top face abuts with the underedges of the stub ends 18′ and 19′ of the window handles 18 and 19 turned to their latching positions and so that the doors are not only prevented from being opened from the outside of the household but the handles are locked in their latching position so that the window doubly locked from inside the household until one produces the key 32 for the securing device. Should the casement handles 18 and 19 be partially unlatched, the pressure exerted in an attempt to turn the handles by engagement of the stub ends with the cross bar portion will tend to keep the handles latched. The ratchet teeth of the locking arms 24 and 26 allow the tumbler lock and pawl mechanism 27 to be adjusted laterally to center the cross bar portion 51 of the back leg strut 49 to equally underlie and span the handle stub ends 18′ and 19′.

It should now be apparent that the tumbler lock and pawl mechanism 27 is permitted with back plate and its cross bar portion to be centered directly under the latched stub ends for their equal distance engagement with cross bar portion 51. That both locking arms are secured in place by the same tumbler lock and pawl mechanism 27 and the ratchet teeth of the respective locking arms respectively extend in opposte directions from one another when in the mechanism 27. That both pawl levers 37 and 38 are lifted into their ratchet connection with their respective oppositely-extending ratchet teeth 26″ and 24″ of the respective slide locking arms 26 and 24 that clip grip respectively the window handles 19 and 18 with the ratchet teeth 24″ and 26″ extending along lowered edges of the respective locking arms 24 and 26 and are adapted to ratchet in opposite directions from through the tumbler lock and pawl mechanism 27. It takes a key to release the pawl levers from the ratchet teeth to separate the locking arms from key-lock mechanism 27.

The lock and pawl mechanism 27 has a main tumbler body 28 with the usual turnable tumbler center 29 with a key hole 31 for receiving a key 32, FIG. 3, by which the various tumblers 29″ in the center 29 and lift tumblers 28″ in the main body 28 against action of springs 28′ to allow the center cylinder 29 to be turned. The tumbler center cylinder 29 has a center extension 29′ to which a cam 33 is keyed at 30 between locked and unlocked positions, FIGS. 5 and 8. In the mechanism 27, are transverse openings or apertures 34 and 36 through which the ratchet locking arms respectively are guided and under which are respectively disposed respective pawl levers 37 and 38 that engage respectively the ratchet teeth 26″ and 24″ that place the arms in a locked condition and held against spreading and separation from one another to release the securing device.

The tumbler lock center 29 contains tumbler pins 29″ that are lifted by key 32 to the cicumferential surface of the center and in turn lists upwardly the body tumblers 28″ in the outer body 28 against action of springs 28′ as is common with tumbler locks.

As seen in FIG. 5, the cam 33 as shown in full line position has an operating lug or enlargement 33′ that extends laterally so that the forward pawl lever 37 is elevated at its engaging end to engage the ratchet teeth 26″ of locking arm 26. As viewed in FIGS. 4, 7 and 8, the pawl 37 is held up by a biasing compression spring 39 seated in a hole 41 engaging the underside of oppositely pivoted rear pawl lever 38 pivoted on pin 43, FIGS. 7 and 9. The forward pawl lever 37 is pivoted upon a pin 42, FIGS. 5, 6 and 8, fixed in the main body 28 and extending parallel to the tumbler axis but spaced therefrom. When the cam 33 is turned 90 degrees from its full line position to its dotted line position 37′, FIG. 5 the pawl levers 37 and 3 are depressed against the action of compression spring 39, the cam lug 33′ releases them free respectively of the ratchet teeth 24″ and 26″ and the respective locking arms 24 and 26 from the tumbler lock and pawl mechanism 27.

In order that both pawl levers 37 and 38 can be acted upon by the same one compression spring 34, the pawl lever 38 which is pivoted upon pin 43 has an elongated edge recess 44, FIGS. 7 and 8, that receives the projected end of a pin 45 and the two pawl levers 37 and 38. The one cam 33 acts to depress the two pawl levers 37 and 38 while the compression spring 39 serves to keep the pawl lever elevated into engagement with the ratchet teeth of the locking arms 24 and 26 against spreading and release of the latch handles. It should be understood that when the lock and pawl mechanism 27 is locked and the pawl levers are upwardly pressed by the compression spring 39 for engagement with the ratchet teeth 24'' and 26'' of the locking arms 24 and 26, the casement window handles are held positively in their depending lock down positions as shown in FIG. 1. The teeth of locking arms 24 and 26 extend in opposite directions but only one tumbler lock and pawl mechanism 27 is used.

To assemble this lock securing device 23 upon the window handles 18 and 19 one locking arm 24 or 26 is attached by its hook end 24' or 26' to one of the window handles 18 or 19 and the ratched teeth end inserted, slid into, and extended through transverse openings 34 or 26 in the lock and pawl mechanism 27. The lock and pawl mechanism 27 is centered on the locking arm so that the back plate member 47 has its cross bar portion 51 aligned with and in engagement with handle lever stub latching ends 18' and 19'. The other locking arm is then hooked over the other handle lever and slid through the other opening or aperture and when moved laterally and with the pawls functuring under action of the single compression spring 39 to back up pawl levers to the ratchet teeth on the underedge of the arms, the securing device 23 will be solidly installed to hold the window handles to prevent them from being turned and the casement windows prevented from being opened to the outside of the household. To release the securing device 23 and permit the handles to be unlatched, the windows opened on their hinges, the key 32 is inserted in the tumbler cylinder 29 and when turned the lug 33' of the cam 33 will depress the pawls 37 and 38 against the action of the spring 39 and the locking arm 24 and 26 are released to permit the window handles to be turned and securing device removed or left upon the handles by their hook ends 24' and 26' FIG. 2.

It should be apparent that the securing device 23 is portable and does not need to be permanently secured to the casement handles when not in use and does not need the tools to install them. It can be taken from one casement window to another and can be applied over the depending opposed latch handles of substantially any difference in configuration. It should also be apparent that the securing device 33 will not mar or scratch the existing hardware on the casement windows and that it can blend with the metal of casement windows and their fixtures thereof. The prior securing devices for casement windows, here and abroad, have had to be permanently installed in the window jamb posts or the handles being specially formed therefor and that not only has been costly but unsightly.

While various changes may be made in the detail construction, it shall be understood that such changes shall be within the spirit and scope of the present invention as defined by the appended claims.

What is claimed is:

1. A portable and detachable double casement window opposing turn latch handles lock securing device comprising two locking arms adapted to be respectively detachably connected to the respective window turn handles in their down turned latching positions and overlie one another in such positions and a lock mechanism adapted to receive the locking arms in their overlying and adjusted positions within the lock mechanism, said locking arms having ratchet teeth extending along their bottom edges, and said lock mechanism including pawls engagable with ratchet teeth of the arms and operable thereupon from opposite directions to engage respectively the respective ratchet teeth to lock the locking arms against movement relative to each other, whereby the window handles will be locked in their opposing down turned latching positions against unauthorized turning.

2. A portable detachable double casement window opposed latch turn handles lock securing device as defined in claim 1 the said turn handles being of a type having stub latching ends extending at an angle from the turn handle proper and adapted to project laterally over a central casement window jamb post when the handles are turned down to their latched positions, said lock mechanism having a back plate with a cross bar portion thereon, said lock mechanism being adjustable when unlocked on the locking arms to permit the back plate cross bar portion to be centered under latched handle stub ends so that when the lock mechanism is centered and locked the opposite ends of the cross bar portion may equally underlie respective bottom edges of the latched stub ends of the down turned latch handles.

3. A portable and detachable double casement window opposing turn latch handles lock securing device as defined in claim 2 and said lock mechanism having a key receiving portion lying forwardly of the locking arms and a rear end portion formed thereon receiving the laterally adjustable locking arms and said back plate fixed to the rear end portion being of U-shape with a short leg, rearwardly extending bight portion and a long upstanding rear leg portion with the cross bar portion extending laterally in T-fashion thereover.

4. A portable and detachable double casement window opposing turn latch handles lock securing device as defined in claim 1 and said lock mechanism having means for biasing the pawls upwardly into engagement within the ratchet teeth of the locking arms said lock mechanism having a turnable member and cam means fixed to turn with said turnable member and engageable with the pawls to release them from the ratchet teeth of the locking arms and the locking arms against the upward locking action of the biasing means.

5. A portable and detachable double casement window opposing turn latch handles lock securing device as defined in claim 4 and said biasing means comprising a solitary compression spring seated in the lock mechanism beneath but one of said pawls to lift the same while the cam engages only the other of said pawl and lost motion connection means extending laterally between the pawls.

6. A portable and detachable double casement window opposing turn latch handles lock securing device as defined in claim 4 and each of said turn handles having stub latching ends extending at an angle from the turn handle proper and adapted to project laterally over a wear plate or keeper on the casement window central jamb post when the handles are turned down to their latched positions, said lock mechanism having a back plate with a cross bar portion and being adjustable, when unlocked, upon the locking arms to center the back plate cross bar portion with the latched handle stub ends so that when the key lock mechanism is centered and locked, the opposite ends of the cross bar portion will equally underlie the respective underedges of the latched stub ends of the down turned latch handles.

7. A portable and detachable double casement window opposing turn latch handles lock securing device as defined in claim 1 and said lock mechanism including a tumbler key cylinder with a detachable key therefor, said locking arms having pawl engagable portions extending therealong said lock mechanism having pawls respectively engagable with the engagable portions of the respective locking arms and said tumbler key cylinder having turnable cam means fixed thereto and engagable with said pawls to release them from the locking arms to allow the arms to be adjusted relative to one another and to the lock mechanism.

* * * * *